US005468082A

United States Patent [19]

Hori

[11] Patent Number: 5,468,082

[45] Date of Patent: Nov. 21, 1995

[54] PRESSURIZED WRITING INSTRUMENT WITH STIRRING WEIGHT

[76] Inventor: Jiro Hori, 61-2, Kamihiroya, Tsurugashima-shi, Saitama-ken, Japan

[21] Appl. No.: 233,522

[22] Filed: Apr. 26, 1994

[30] Foreign Application Priority Data

Apr. 26, 1993 [JP] Japan ..... 5-099308
Apr. 26, 1993 [JP] Japan ..... 5-099309

[51] Int. Cl.[6] ..... B43K 7/00; B43K 7/03; B43K 9/00

[52] U.S. Cl. ..... 401/4; 401/187; 401/188 A; 401/213; 401/214

[58] Field of Search ..... 401/4, 214, 188 A, 401/187, 213

[56] References Cited

U.S. PATENT DOCUMENTS

| | | | |
|---|---|---|---|
| 853,156 | 5/1907 | Brenton | 401/214 |
| 1,848,358 | 3/1932 | Kratz | 401/187 |
| 2,227,235 | 12/1940 | Robbins | 401/4 |
| 2,643,639 | 6/1953 | Kuhn | 401/4 |

FOREIGN PATENT DOCUMENTS

| | | | |
|---|---|---|---|
| 517883 | 5/1921 | France . | |
| 2452386 | 11/1980 | France | 401/214 |
| 2844450 | 4/1980 | Germany . | |
| 627780 | 11/1961 | Italy | 401/4 |
| 208239 | 6/1993 | Taiwan . | |
| 10318 | of 1914 | United Kingdom . | |
| WO87/01338 | 12/1987 | WIPO . | |

OTHER PUBLICATIONS

Patent Abstracts of Japan, vol. 17, No. 368 (M–1443) 12 Jul., 1993.

*Primary Examiner*—Steven A. Bratlie
*Attorney, Agent, or Firm*—Jacobson, Price, Holman & Stern

[57] ABSTRACT

A writing instrument has an ink reservoir under pressure. Compressed ink in the ink reservoir is supplied through an ink passage to a ball tip also acting as a valve body. A push rod is inserted in the ink passage and is intended to urge the ball forward. The ball tip is in a closed state when the writing instrument is used and is in an open state when the writing instrument is used for supplying ink. A stirring weight is housed in the ink reservoir. When the writing instrument is swung, the stirring weight is moved to stir ink in the ink reservoir. The stirring weight interferes with the push rod to displace it. The push rod is displaced to stir ink in the ink passage whereby ink containing air and/or air bubbles in the ink passage is removed.

5 Claims, 9 Drawing Sheets

PRESSURIZED WRITING INSTRUMENT WITH STIRRING WEIGHT

BACKGROUND OF THE INVENTION

1. Field of the Invention

The present invention relates to a writing instrument such as a correction liquid marker, a paint marker and the like, and more particularly to a writing instrument which can stir in the ink passage ink which is being supplied from the ink reservoir to the nib.

2. Description of the Related Art

More particularly, the present invention relates to an improvement of a writing instrument which compresses air in a cap to be forced into the main body when the cap is mounted on the main body so that ink is supplied to the nib under the pressure of the compressed air.

various kinds of correction liquid markers have recently developed for applying correction liquid to required portions. These developed correction liquid markers have the advantages that they can be used more conveniently than the conventional ones and they can be applied to narrow portions with clear contour.

FIG. 1 shows a conventional correction liquid marker. A main body 1 is cylindrical and contains an ink reservoir 2 which is filled with correction ink or correction liquid. To the front end of the main body 1 is connected a nib holder 5 whose front end portion holds a nib portion such as a ball tip 3. The front end of the ball tip 3 holds a ball 4 having a relatively large diameter. An ink passage 8 extends through the nib holder 5 and the ball tip 3 and connects the ink reservoir 8 to the interior of the ball tip 3. A spring 6 is provided in the ink passage 8. A push rod 7 made of a piano wire, for example, extends to the ball 4 from an end of the spring 6 which is remote from the ink reservoir 2. The free front end of the push rod 7 abuts against the ball 3 so that the ball 4 is urged forward to close the ball tip 3.

A cap 9 is slidably fitted in an air tight manner on the front end portion of the nib holder 5. Upon fitting the cap 9 on the nib holder 5, air in the cap 9 is compressed and is pushed in the ink reservoir 2 through the ink passage 3.

Stirring weights 10 such as steel balls are provided in the ink reservoir 2 and are moved therein by swinging the correction liquid marker.

The correction liquid marker of this type is usually called a cap compression type writing instrument. Every time the cap 9 is fitted on the nib holder, air is introduced under pressure in the ink reservoir 2, thereby permanently maintaining a predetermined pressure in the ink reservoir 2. Since the ball 4 is urged forward by the spring 6 and the push rod 7 and by the pressure in the ink reservoir 2 as well, the ball tip 3 is closed by the ball 4 to prevent correction liquid from flowing out from the correction liquid marker when the marker is not in use.

Upon using the marker, the ball 4 is retracted slightly by the pressure applied by the marker against the urging forces by the spring 6 and the internal pressure of the ink in the ink reservoir 2. The ball 4 is released from the ball tip 3 and the correction liquid under the pressure in the ink reservoir 2 flows out. Rolling of the ball 4 by use of the marker allows correction liquid to be applied to the required portion. The correction liquid has a disadvantage that pigment contained in the correction liquid is likely to be deposited. The conventional correction liquid marker is constructed so that the stirring weights 10 are provided in the ink reservoir 2 and the correction liquid is stirred by moving them in the ink reservoir 2. However, the correction liquid between the ink reservoir 2 and the ball 4 in the ball tip 3 cannot be stirred by the stirring weights 8. Pigment in the correction liquid in the ink passage 8 is deposited, and the correction liquid in which the pigment is sometimes deposited is supplied at the initial stage of the use of the marker. Further, air is likely to be accumulated in the ink passage 8. Thus, air in the ink passage 8 is not removed from the ink passage 8, even if the correction liquid in the ink reservoir 2 is stirred by swinging the correction liquid marker. In this regard, the correction liquid sometimes becomes blurred by the air in the ink passage 8 at the beginning of use of the marker.

When the cap 9 is fitted on the nib holder 5, air in the cap 9 to be pushed in the correction liquid marker is compressed and retracts the ball 4 against the urging force of the spring 6. The urging force of the spring 6 must be somewhat large so as to close the ink passage 8 securely. Upon fitting the cap 9 on the nib holder 5, therefore, the air under pressure in the cap 9 is sometimes not pushed in the correction liquid marker fully.

when the cap 9 is mounted on the nib holder 5 in the marker of a cap compression type, air compressed in the cap 9 retracts the ball 4 in the ball tip 3 and enters the ink reservoir 2 under pressure. The pressure in the cap 9 and the pressure in the ink reservoir 2 gradually become in equilibrium with each other, and the amount of air entering the ink reservoir 5 through the ball tip 3 gradually decreases. The air compressed into the ink passage 8 or the ink reservoir 2 is initially diffused in the ink as air bubbles. But it is gathered to form large air bubbles and is finally separated from the ink to be changed into the gaseous phase in the ink reservoir 2. However, as the pressures in the cap 9 and the ink reservoir 2 become in equilibrium with each other and the flowing amount of the air is reduced as described above, the compressed air is changed into extremely fine air bubbles and is diffused in the ink. The ink containing the extremely fine air bubbles has apparently high viscosity. The very fine air bubbles are not gathered together easily, and ink containing the very fine air bubbles remains in the ink passage 8 for a long time. Since the contact area with the air bubbles, i.e., air is very large, the ink in this state is solidified as time passes, and the viscosity becomes larger, whereby the ink passage 8 clogs with the ink. This phenomenon occurs to ink easily when the ink is correction liquid, but it sometimes occurs to any other ink.

As described above, the problems occurring to the conventional writing instruments were described by way of a correction liquid marker. However, the paint marker, and any other writing instrument having the same structure as the correction liquid marker, have encountered the same problems.

SUMMARY OF THE INVENTION

The present invention was made to avoid the abovementioned circumstances, and the first object thereof is to provide a writing instrument in which ink supplied from an ink reservoir to a nib is ensured to be stirred in an ink passage and which can prevent ink and air bubbles from staying in the ink passage. The second object of the present invention is to provide a writing instrument in which air compressed by fitting a cap on the main body is ensured to be pressed into the writing instrument when the writing instrument is of a cap compressing type.

In order to achieve these objects, a writing instrument according to the present invention is provided with a pushing member for urging a nib which is inserted in an ink passage so that the pushing member interferes with a stirring weight in an ink reservoir.

When the writing instrument is swung, the stirring weight is moved in the ink reservoir and the ink in the ink reservoir is stirred. The stirring weight interferes with the pushing member to displace it. Part of the pushing member is moved in the ink passage to stir the ink in the ink passage so that the air contained in the ink passage is removed. Thus, the writing instrument writes well from the beginning. When a writing instrument a cap compression type, is swung the stirring weight is moved to displace a stirring member acting as an urging member as well. Ink in the ink passage is stirred, and an urging force for closing a nib or a valve is released instantaneously. Air compressed in the cap is ensured to be pressed into the writing instrument for a short time, whereby the compressed air is prevented from being diffused in ink as fine air bubbles.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiments according to the present invention will be described with reference to the accompanying drawings.

Figure 1:
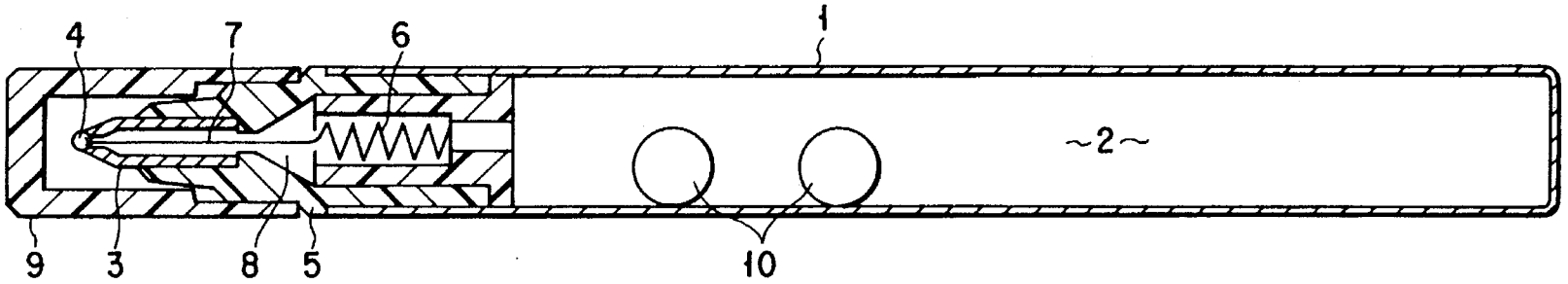
FIG. 1 PRIOR ART
FIG. 1 is a longitudinal cross-sectional view of a conventional correction liquid marker.
Figure 2:
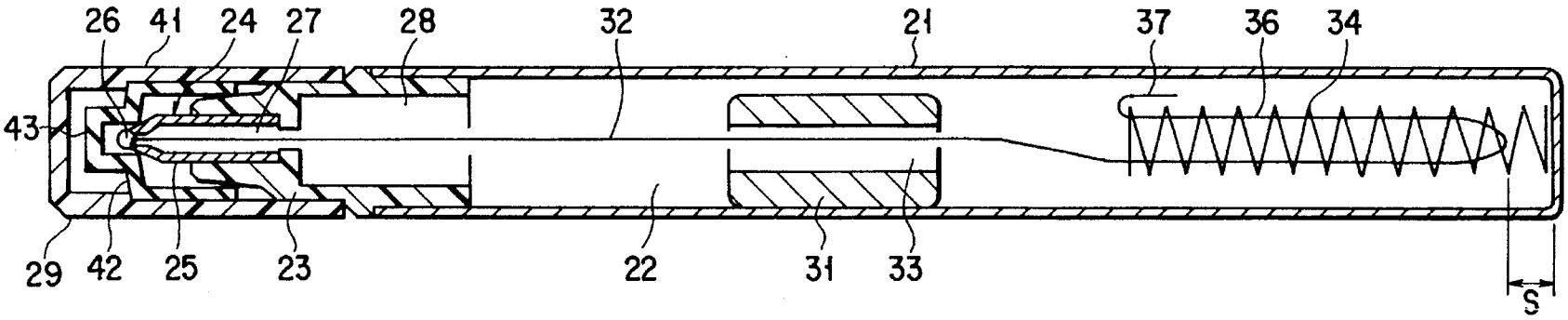
FIG. 2 is a longitudinal cross-sectional view of a correction liquid marker according to a first embodiment of the present invention.

FIG. 2 shows a first embodiment of a writing instrument of a cap compression type which is a correction liquid marker having a ball tip.

The correction liquid marker has a cylindrical main body 21 made of a material such as aluminum. In the main body 21 is formed an ink reservoir 22 which is filled with correction liquid. A nib holder 23 is connected to the front end portion of the main body 21. A nib or a ball tip 24 is fixed to the front end portion of the nib holder 23. The ball tip 24 has a cylindrical holder 25 whose front end holds a ball 26 having a relatively large diameter such as 1 millimeter. An ink passage 27 is formed in the ball passage 25, and another ink passage 28 is formed in the nib holder 23. The front end of the ball tip 24 communicates with the ink reservoir 22 through the ink passages 27 and 28.

A cap 29 comprises a cap body 41 and an inner cap 42 fitted in the cap body 41, and is mounted on the nib holder 23. The cap body 41 is fitted on the nib holder 23 in an air tight manner. When the cap body 41 is fitted, air in the cap body 41 is compressed and conducted into the ink reservoir 22 through the ball tip 24. The inner cap 42 is made of an elastic material such as rubber. The front end portion of the inner cap 42 is reduced in diameter and forms a cylindrical fit-sealing portion 43 having a general cylindrical blind-ended hole. The inner cap 42 is fitted on the inner peripheral surface of the cap body 41 in an air tight manner. The interior of the cap body 41 is divided by the inner cap 42 into two hermetical sections. When the cap body 41 is fitted on the correction liquid marker, the front end portion of the nib holder 23 is inserted in the inner cap 42, and only the front end portion of the ball tip 24 is inserted in the fit-sealing portion 43.

Figure 6:
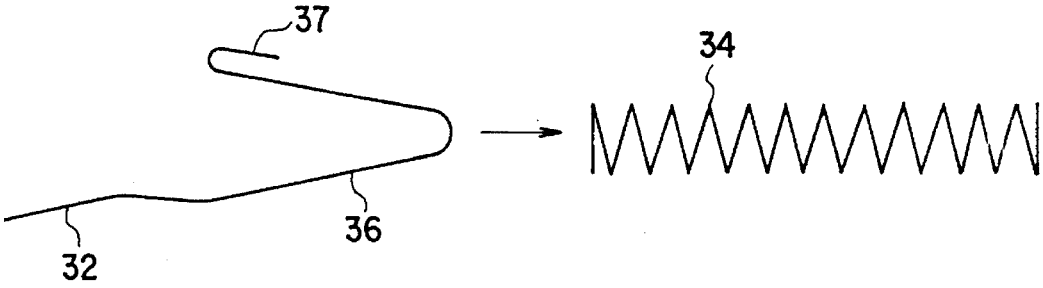
FIG. 6 is a side view of a spring of a push rod.

A push rod 32 and a coil spring 34 are provided in the marker. They urge the ball 26 of the ball tip 24 to its front end to close it. The push rod 32 is formed by a piano wire having a small diameter and inserted in the ink passages 28 and 27. The front end of the push rod 32 is pressed against the ball 26. The push rod 32 also acts as a stirring member for stirring ink in the ink passage 27. As shown in FIG. 6, the rear end section of the push rod 32 is formed into a U-shaped bent part 36, and the rear end portion of the U-shaped bent part 36 is formed into a U-shaped engaging portion 37. The bent part 36 is pressed into the coil spring 34 in a compressed state, and the engaging portion 37 engages the front end portion of the spring 34. The rear end portion of the spring 34 abuts against the inner face of the rear end wall of the main body 21 so that the spring 34 is in predetermined compressed state. Thus, the push rod 32 is urged forward by the urging force of the spring 34. The ball 26 in the ball tip 24 is urged forward by the push rod 32 under a predetermined pushing force so as to retain the closed state.

A stirring weight 31 is housed in the ink reservoir 22. The stirring weight 31 is made of a material having a large specific weight such as steel. It is generally cylindrical and is formed in its center with a longitudinal hole 33. The push rod 32 extends through the hole 33. The outer diameter of the stirring weight 31 is slightly smaller than the inner diameter of the ink reservoir 22. By moving the stirring weight 31 lengthwise in the ink reservoir 22, correction liquid flows lengthwise through a space between the outer peripheral surface of the stirring weight 31 and the inner peripheral surface of the ink reservoir 22 and through the hole 33.

The ball 24 in the ball tip 24 is retracted slightly by the writing pressure of the correction liquid marker against the urging force of the spring 34, thereby releasing the ball 26 from the ball tip 24. In this way, the correction liquid flows out of the front end of the ball tip 24 by the pressure in the ink reservoir 22 and is applied to a required portion as the ball 26 rolls.

The stirring weight 31 reciprocates lengthwise in the ink reservoir 22 by swing of the marker, and the correction liquid is uniformly stirred in the ink reservoir 22. Because the ink passage 28 in the nib holder 23 has a relatively large diameter, the correction liquid in the ink passage 28 is also stirred by movement of the stirring weight 31. The stirring weight 31 is moved rearward and collides with the spring 34. Then, the spring 34 is shortened by the inertia of the stirring weight 31 for a short time, and the push rod 32 is retracted by the compression of the spring 34. The push rod 32 repeats advance and retreat according to reciprocation of the stirring weight 31. The correction liquid in the small-diameter ink passage 28 in the ball holder 25 of the ball tip 24 is stirred according to the reciprocation of the push rod 32. Therefore, the correction liquid in this part is fully stirred. Correction liquid which contains air bubbles and/or correction liquid from which pigment has been separated is removed. Thus, the ink passage 27 is prevented from being clogged. At the same time, neither correction liquid in which air bubbles are contained nor correction liquid from which pigment has been separated is supplied at the beginning of use of the marker. Even if relatively large air bubbles exist in the small-diameter ink passage 27, the movement of the push rod 32 removes such large air bubbles. Thus, correction liquid does not become blurred at the beginning of use of the marker. Since the rear end of the bent part 36 of the push rod 32 abuts against the rear end wall of the ink reservoir 22 and acts as a stop when the stirring weight 31 collides with the spring 34 to compress the spring 34, the reciprocating range of the push rod 32 is limited to the distance S as shown in FIG. 2.

When the push rod 32 is moved back and forth, the forward urging force, i.e., the urging force in the closing direction, is released for a short time. In this regard, the ball 26 is released from the ball holder 25 intermittently for a short time by swinging the marker after the cap 29 has been mounted on the rib holder 23, and air compressed in the cap 29 is ensured to be pressed into the ink reservoir 22. As air is pressed in the cap 29, the thus compressed air instantaneously flows in a large amount, the pressed-in air is prevented from being diffused into ink as fine air bubbles.

The operation of the cap 29 will be described with reference to FIGS. 3 to 5 in detail.

Figure 3:
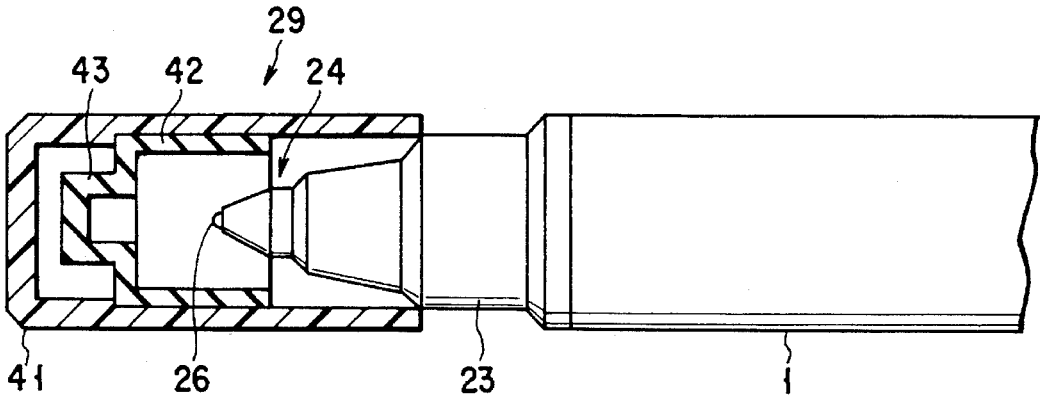
FIG. 3 is an enlarged longitudinal cross-sectional view of a cap and a vicinity thereof.

When the cap 29 is not fitted on the nib holder 23 as shown in FIG. 3, the pressure in the cap body 41 is the same as the atmospheric pressure, and there is no difference between the differences of the two sections divided by the inner cap 42. In this state, the inner cap 42 has not yet been deformed and takes the initial shape.

Figure 4:
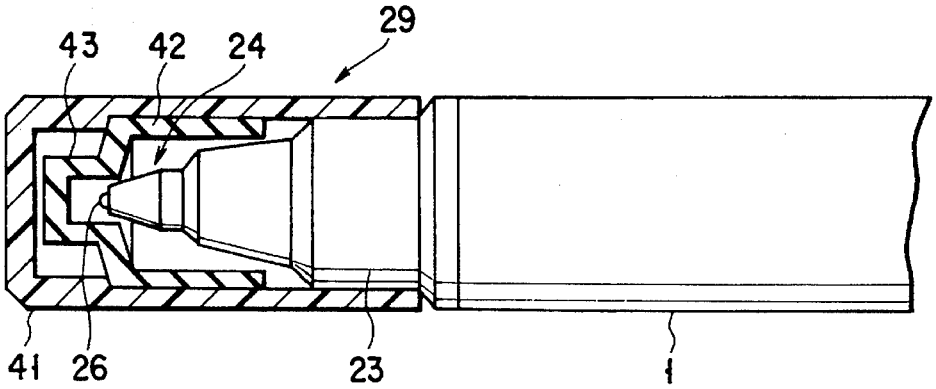
FIG. 4 is an enlarge longitudinal cross-sectional view of the cap and the vicinity thereof in a different state from that of FIG. 3.
Figure 5:
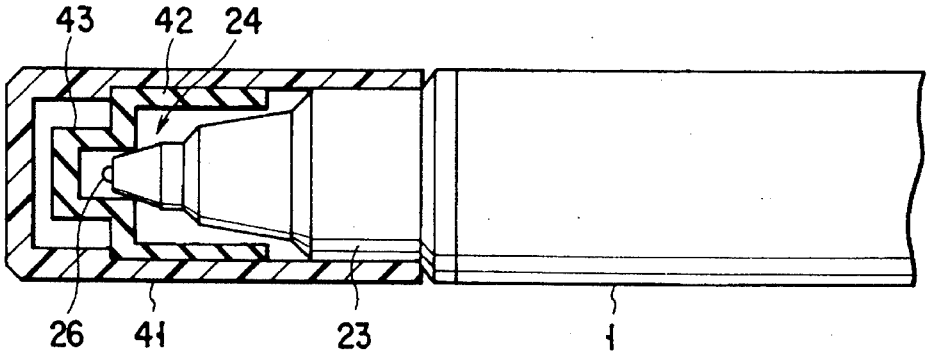
FIG. 5 is an enlarge longitudinal cross-sectional view of the cap and the vicinity thereof in a further different state from that of FIG. 3.

When the cap 29 is fitted on the nib holder 23 as shown in FIG. 4, the inner peripheral surface of the rear end portion of the cap body 41 slides on the outer peripheral surface of the nib holder 23 in an air-tight state in such a way that air in the right-side space of the inner cap 42 of the cap body 41 is compressed. Pressure difference occurs between the two sections of the inner cap 42, and the inner cap 42 is elastically deformed by the pressure difference. A fit-sealing portion 43 is displaced forward and increases in the diameter. When the cap 29 is fitted, the front end of the ball tip 24 enters the fit-sealing portion 43 without touching its inner peripheral surface.

When air is compressed in the cap 29 as shown in FIG. 4, it is conducted into the marker under pressure through the ball tip 24. The pressure is still present, and the inner cap 42 is left inflated. When air is not fully conducted into the marker at the initial stage of use of the marker, the ball tip 24 is released for a short time by swinging the marker as mentioned before. Then, air is ensured to enter the marker.

When the state of FIG. 4 is kept, the air in the inner cap 42 leaks a little by a little, and the pressure in the inner cap 42 becomes equal to the atmospheric pressure. As shown in FIG. 5, the inner cap 42 is restored to the original shape by its elastic force. The fit-sealing portion 43 is retracted and is reduced in diameter. It contacts the front end portion of the ball tip 24 closely.

Since the fit-sealing portion 43 having a small volume contacts only the front end portion of the ball tip 24, correction liquid attached to the front end portion of the ball tip 24 is securely prevented from being dried when the cap 29 is fitted, the front end portion of the ball tip 24 does not contact the front end of the ball tip 24. As the cap 29 is being fitted, the fit-sealing portion 43 gradually closely contacts the front end portion of the fit-sealing portion 43. Thus, the fit-sealing portion 43 is neither worn nor deformed. Correction liquid is not attached to the fit-sealing portion 43. The fit-sealing portion 43 maintains its durability and performs secure sealing. Even if air in the ink reservoir of the marker is expanded by thermal expansion or the like and the internal pressure is higher than the air pressure produced by fitting of the cap 29, the ball 26 contacts the fit-sealing portion 43 upon fitting of the cap 29 so that the ball 26 is prevented from being released from the fit-sealing portion 43 undesirably and correction liquid is prevented from gushing out by the internal pressure.

In the front end portion of the cap body 41 may be formed a ventilation hole for causing the front section of the cap 29 divided by the inner cap 42 from the remaining portion of the cap 29 to communicate with the outer atmosphere. The cap 41 is not limited to the one having the structure as mentioned above. A cap having any structure is possible as long as it is fitted on the main body hermetically and can protect the nib mechanically. An inner cap having any structure is also possible as long as it is deformed upon fitting by the pressure difference, its fit-sealing portion is fitted on the peripheral surface of the ball tip without touching the nib portion and the inner cap closely contacts the front end portion of the nib portion by restoring its shape when the pressure difference disappears due to air leakage occurring afterward.

Figure 7:
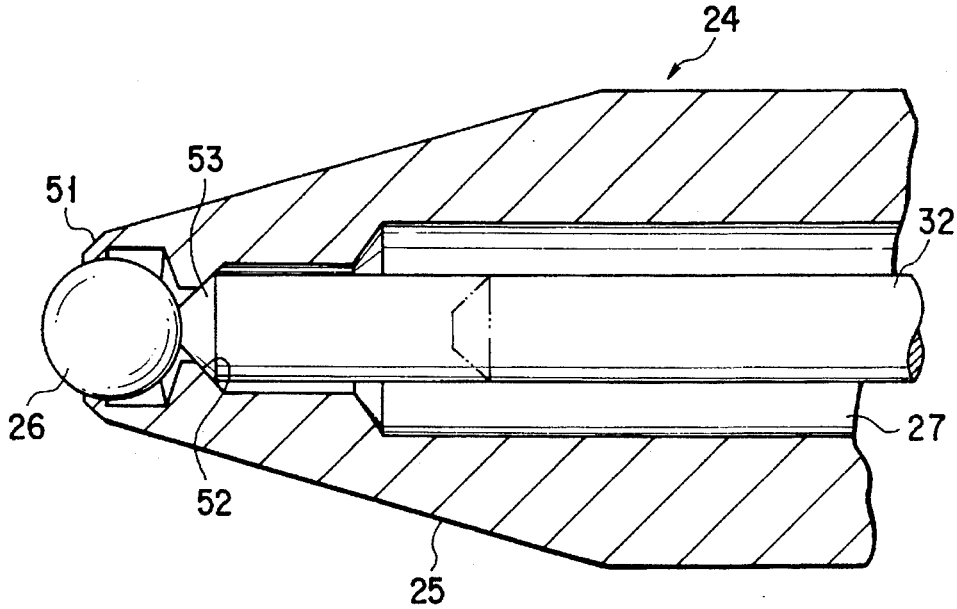
FIG. 7 is an enlarged longitudinal cross-sectional view of a ball tip.

FIG. 7 is an enlarged view of the front portion of the ball tip 24 and the front end portion of the push rod 32 of the correction liquid. The ball 26 is held by a lip portion 51 formed on the front end portion of the ball holder 25. A conical seating surface 52 defining an angle of about 90° is formed behind the ball 26. A conical taper surface 53 defining about 90° is formed on the front end portion of the push rod 32 and is seated on the seating surface 52. The front portion of the taper surface 53 of the push rod 32 extends beyond the seating surface 52 to contact the ball 26. The ball 26 is urged forward to push the lip potion 51 so as to retain the closed state of the ball tip 24.

Upon using the marker, the ball 26 is slightly retracted by the pressure of the marker against the urging force of the push rod 32. A space is formed between the ball 26 and the lip portion 51, and the taper surface 53 is separated from the seating surface 52. Thus, correction liquid flows out by the pressure in the ink reservoir and is applied to a required portion as the ball 26 rolls. When the lip portion 51 is worn or deformed and the ball 26 falls off the lip portion 51, the taper surface 53 seats on the seating surface 52 to interrupt flow of correction liquid, preventing a lot of correction liquid from gushing out by the internal pressure.

Figure 8:
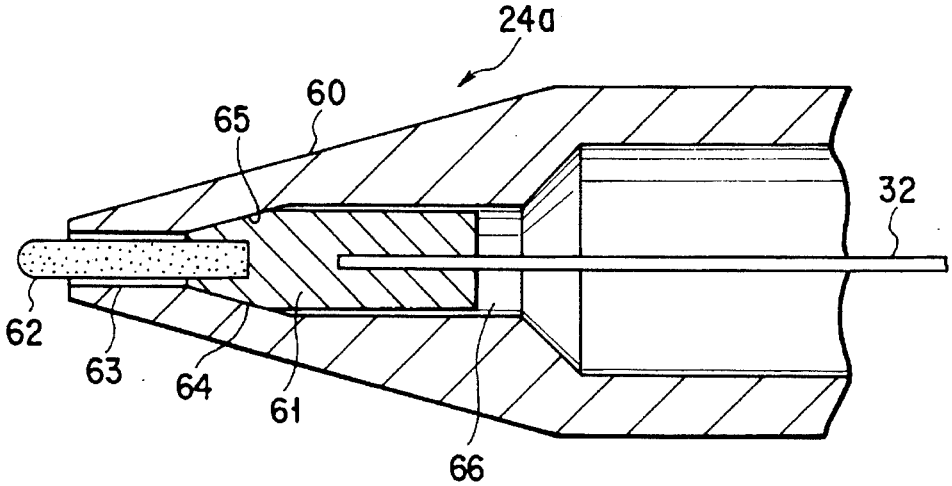
FIG. 8 is a longitudinal cross-sectional view of a second embodiment of a nib and its vicinity.

The present invention is not limited to this embodiment. For example, FIG. 8 shows a second embodiment of a marker, such as a paint marker, provided with a felt tip 62 as a nib. A ball tip **24*a* is provided with a holder 60 and a valve body 61. On the front end potion of the valve body is formed a taper surface 64 which seats on a seating surface 65 formed on the holder 60. A felt tip 62 is provided in the front end of the valve body 61. A space 63 is formed between the outer surface of the felt tip 62 and the inner surface of the holder 60. The front end portion of a reciprocating push rod 32 is inserted in the valve body 61. The other structure of the push rod 32 of this embodiment is the same as that of the push rod 32 of the first embodiment. When a stirring weight is moved by swinging the marker, the push rod 32 is displaced to stir ink in an ink passage 66. The valve body 62 of the marker of a cap compression type is instantaneously released, and air compressed by fitting the cap is pressed into the marker. In the second embodiment, the push rod 32 may be integral with the valve body 61** so that the push rod is moved together with the valve body.

Figure 9:
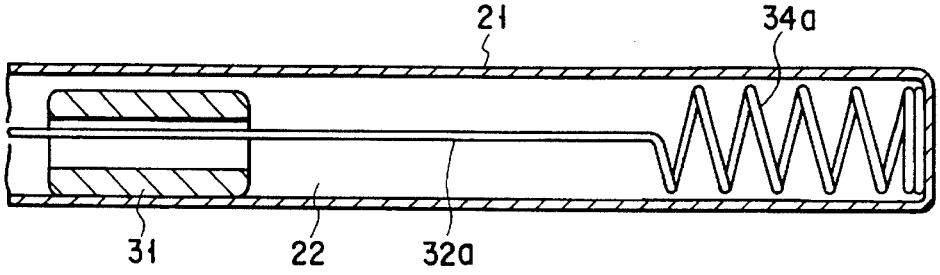
FIG. 9 is a longitudinal cross-sectional view of a related portion of a correction liquid marker which includes a push rod and a spring according to a third embodiment of the present invention.

FIG. 9 shows a third embodiment according to the present invention. A pushing member made of a piano wire or the like comprises a push rod **32*a* and a spring 34*a*** formed integral therewith.

Figure 10:
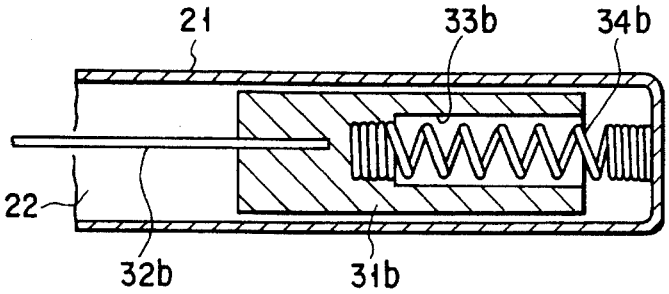
FIG. 10 is a longitudinal cross-sectional view of a related portion of a writing instrument which includes a push rod and a spring according to a fourth embodiment of the present invention.

FIG. 10 shows a fourth embodiment. The rear end portion of a stirring weight **31*b* is connected to the front end potion of a stirring weight 31*b*. In the rear portion of the stirring weight 31*b* is formed a blind hole 33*b* into which a spring 34*b*** is inserted. The other structure of the third and fourth embodiments are the same as those of the first and second embodiments.

Figure 11:
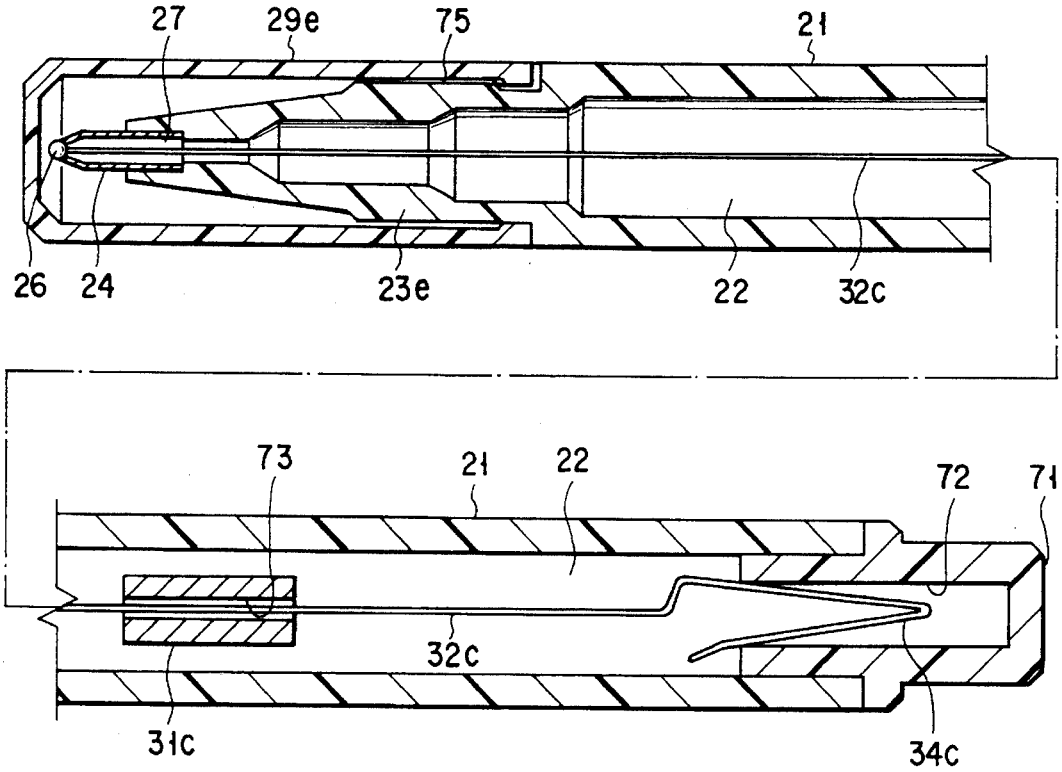
FIG. 11 is a longitudinal cross-sectional view of a fifth embodiment of the present invention.

FIG. 11 shows a fifth embodiment. A push rod **32*c* is made of a piano wire or the like has a rear end portion formed with a V-shaped spring portion 34*c* which is fitted in a hole 72 formed in an end plug 71. The push rod 32*c* is urged forward by the urging force of the spring 31*c*. A stirring weight 34*c* is slidably guided by the push rod 32*c*. In the center of the weight 31*c* is formed a through hole 73 having a diameter slightly larger than the diameter of the push rod 32*c*. The push rod 32*c* extends through the through hole 73. The outer diameter of the weight 31*c* is formed much smaller than the inner diameter of the ink reservoir 22 so that the weight 31*c* can also be moved radially in the ink reservoir 22**.

The fifth embodiment functions similarly to the first embodiment. When the marker is swung, however, the weight **31*c* is moved not only longitudinally but also radially to bend the push rod 32*c*. As a result, the front end portion of the push rod 32*c* is moved crosswise in the ink passage 27, increasing an stirring effect in the ink passage 27**.

Figure 12:
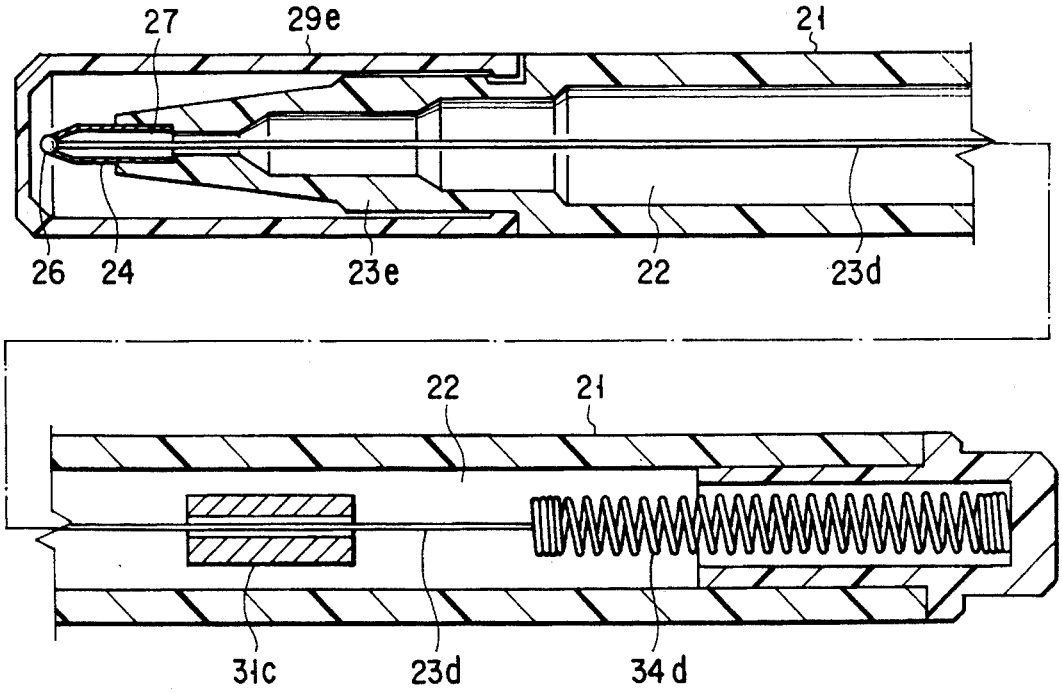
FIG. 12 is a longitudinal cross-sectional view of a sixth embodiment of the present invention.

FIG. 12 shows a sixth embodiment, which has the same structure as the fifth embodiment except that a coil spring **34*d* is formed on the rear end portion of a push rod 32*c***. The parts and elements of the six embodiment which correspond to those of the fifth embodiment are designated by the same reference numerals and their description are omitted.

Figure 13:
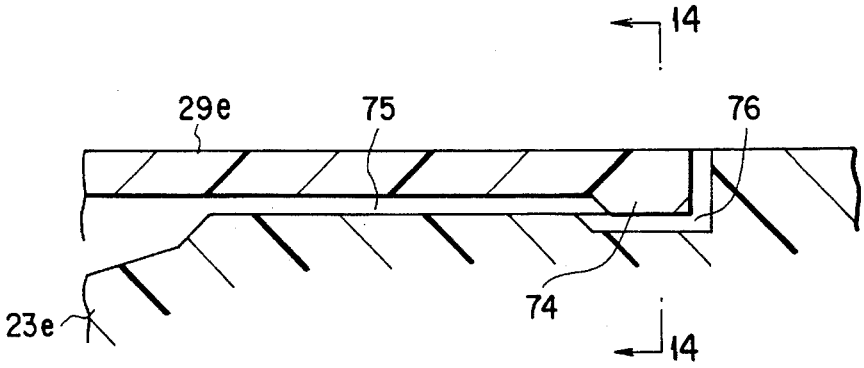
FIG. 13 is a longitudinal cross-sectional view of a first example of cap.
Figure 14:
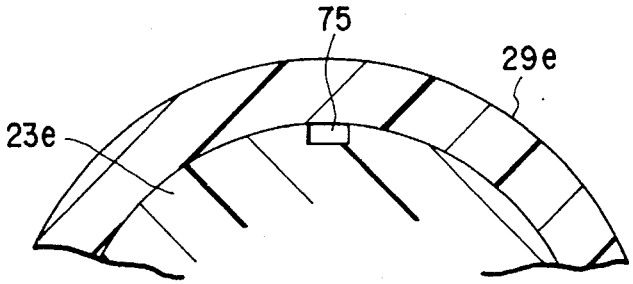
FIG. 14 is a cross-sectional view along line 14—14 of FIG. 13.

In the fifth and sixth embodiments shown by FIGS. 11 and 12 is used a cap having a structure different from that of the cap of the first embodiment. The cap of the fifth and sixth embodiments is shown in FIGS. 13 and 14. The cap is intended to prevent air from becoming air bubbles and diffusing in ink.

The cap **29*e* of the fifth and sixth embodiments has generally the same structure as the first embodiment. However, it lacks an inner cap, and an annular sealing projection 74 is formed on the inner peripheral edge portion of the rear end portion of the cap 29*e*. A cylindrical compression sliding portion 75 having a smooth surface is formed on the outer peripheral surface of a nib holder 23*e*. When the cap 29*e* is fitted, the sealing projection 74 contacts the compression sliding portion 75 to pressure air in the cap 29*e*. A space is formed between the other portion of the inner peripheral surface of the cap 24*e* and the outer peripheral surface of the compression sliding portion 75**.

In the rear end portion of the compression sliding portion 75 is formed a discharge portion which comprises a discharge groove 76 in these embodiments. As shown in FIG. 14, the discharge groove 76 extends from the end portion of the outer peripheral surface of the compression sliding portion 75 to the stepped portion of the nib holder **23*e*. When the cap 29*e* is fitted fully, the interior and exterior of the cap 29*e* communicate with each other through the discharge groove 76**.

When the cap **24*e* is fitted fully, the compressed air in the cap 29*e* is discharged to the outer atmosphere through the discharge groove 76 to stop pressing-in of the air. After the cap 29*e* has been fitted fully, the pressure in the cap 29*e* is in equilibrium with the pressure in the ink reservoir 22**. The amount of pressed-in air decreases, and the pressed-in air is prevented from becoming extremely fine air bubbles and diffusing in ink.

Since the interior of the cap communicates with the outer atmosphere when the cap is fitted fully, the marker of these embodiments is suited for using ink which is not easily dried.

Figure 15:
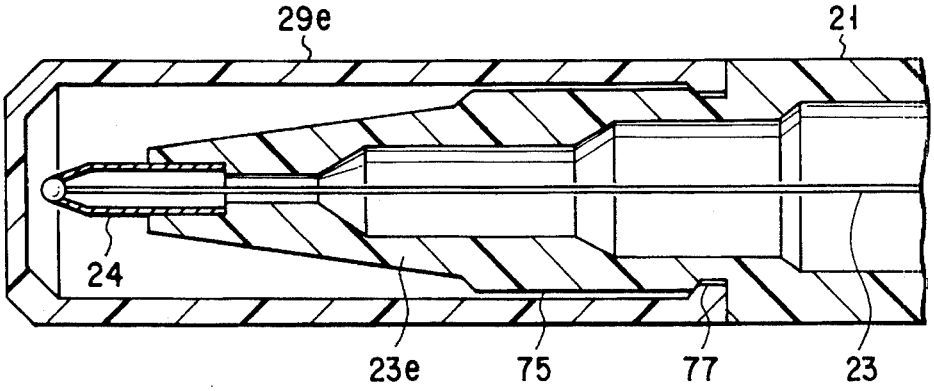
FIG. 15 is a longitudinal cross-sectional view of a second example of a cap.

FIG. 15 shows a second embodiment of a cap which has a small-diameter portion 77 formed by reducing the rear end portion of the compression sliding portion 75 as a discharge portion. An annular space for discharging air is formed at the small-diameter portion 77.

Figure 16:
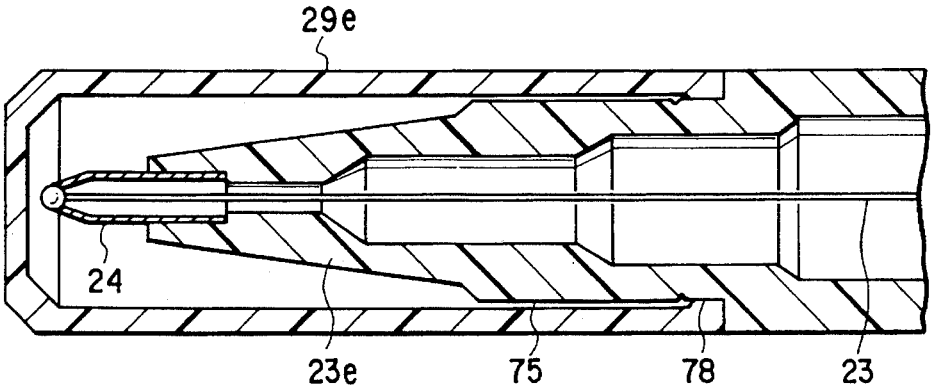
FIG. 16 is a longitudinal cross-sectional view of a third example of a cap.

FIG. 16 shows a third embodiment of a cap which has a rough surface portion 78 like a pear-skin surface, as a discharge portion, formed with fine projections and depressions on the outer peripheral surface of the rear end portion of the compression sliding portion 75. When the cap 29*e* is fitted fully, air is discharged from the rough surface portion 78.

Figure 17:
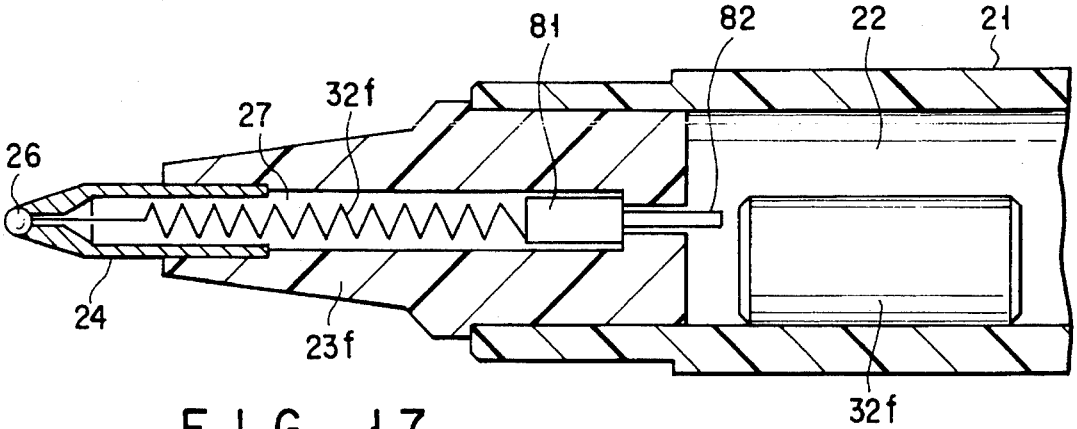
FIG. 17 is a longitudinal cross-sectional view of a nib and its vicinity of a writing instrument according to a seventh embodiment of the present invention.
Figure 18:
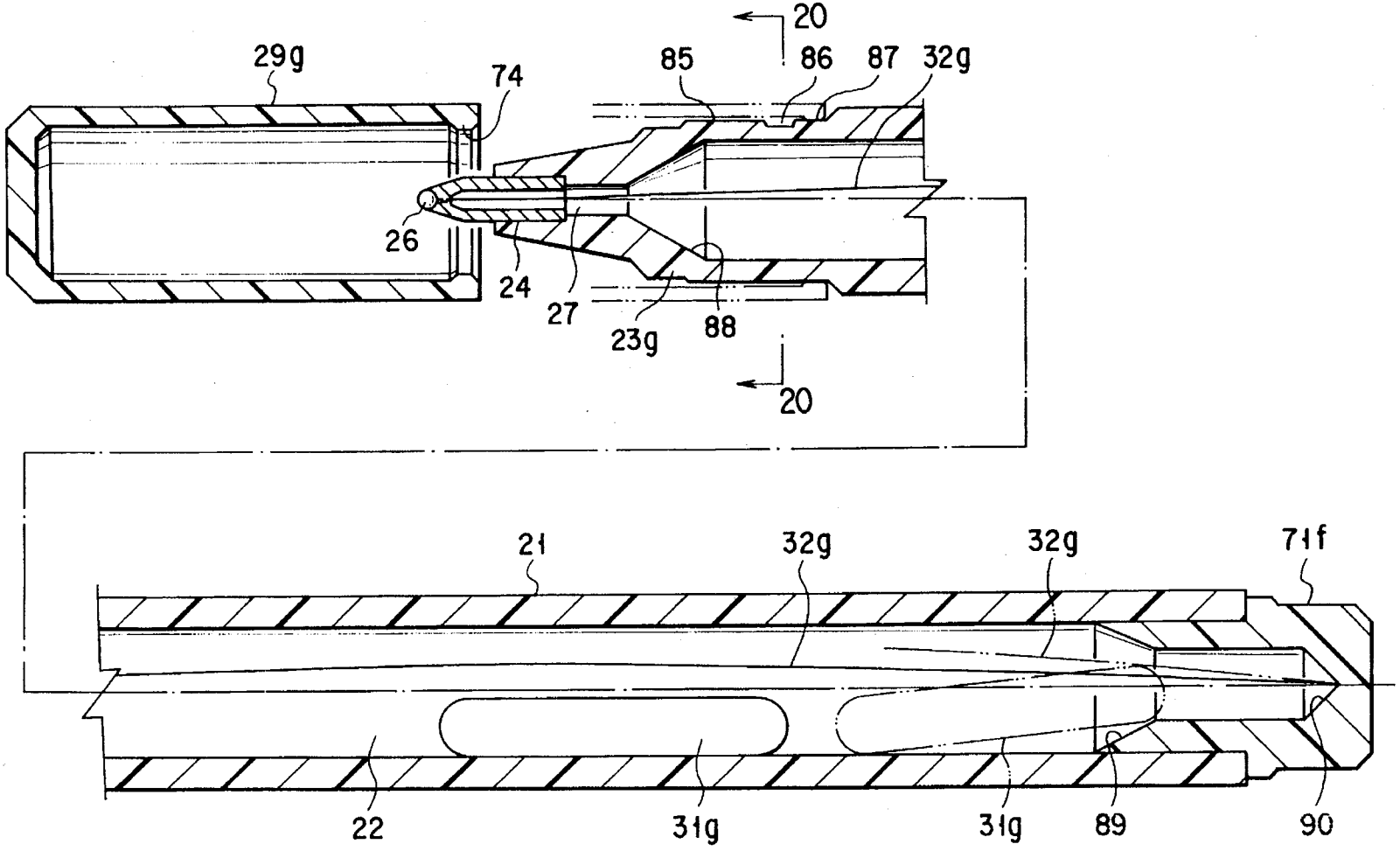
FIG. 18 is a longitudinal cross-sectional view of an eighth embodiment.

FIG. 17 shows a seventh embodiment. In a nib holder 23*f* is provided a push rod 32*f* having a coil portion. A ball 26 in a ball tip 24 is urged by the push rod 32*f*. A pushing member 81 is provided axially slidably in the rear end portion of the nib holder 23*f*. The rear end of the coil spring portion of the push rod 32*f* abuts against the pushing member 81. A projection 82 extends from the rear end of the pushing member 81 into an ink reservoir 22 of the main body 21 of the marker through the rear end portion of the nib holder 23*f*.

In the seventh embodiment, a stirring weight 32*f* is moved in the ink reservoir 22 to stir ink or correction liquid in the ink reservoir 22. At the same time, the stirring weight 32*f* collides with the projection 82 of the push rod 81 and the pushing member 81 is intermittently moved forward. The pushing member 81 is moved back and forth in the ink passage 27 in the nib holder 23*f*. Correction liquid in the ink passage 27 is stirred and is moved between the ink passage 27 and the ink reservoir 22. In this way, correction liquid containing air and/or bubbles in the ink passage 27 is removed.

FIGS. 18 to 22 show an eighth embodiment, which is easy to manufacture and is suited for correction liquid marker, a paint marker and the like. The marker has a main body 21 and a nib holder 23*g* both made of synthetic resin and formed integral with each other. An end plug 71*f* is provided on the rear end portion of the main body 21. In the end plug 71*f* is formed a hole opening to the ink reservoir 22. The hole has an inner end forming a conical rod receiving portion 90. A linear push rod 32*g* extends through the ink passage 27 of the nib holder 23*g* and the ink reservoir 22 over the whole length of them. The push rod 32*g* is formed by cutting a thin piano wire to a predetermined length. Its length is slightly larger than the distance between the ball 26 in the ball tip 23 and the rod receiving potion 90 of the end plug 71*f*. The front end of the push rod 32*g* abuts against the ball 26, and the rear end of the push rod 32*g* engages the rod receiving portion 90 so that the whole length of the push rod 32*g* is bent. The ball 26 is urged forward by the urging force which restores the push rod 32*g* to a straight state.

In the eighth embodiment of a writing instrument or a marker, a taper portion 88 is formed on the front end portion of the ink reservoir 22, i.e., in the nib holder 23*g*, another taper portion 89 is formed on the inner end face of the end plug 71*f*. A cylindrical stirring weight 31*g* is provided in the ink reservoir 22. The stirring weight 31*g* is moved axially in the ink reservoir 22 by swinging the writing instrument or marker to stir ink, for example, correction liquid. The stirring weight 31*g* collides with the taper portions 88 and 89 of the front and rear end portions of the ink reservoir 22. As shown by a double-dot chain line in FIG. 18, the stirring weight 31*g* is tilted with an end moved radially toward the center of the ink reservoir 22. The end of the stirring weight 31*g* collides with the push rod 32*g* , and the push rod 32*g* is largely curved radially outwardly, i.e., in a direction perpendicular to the axis of the ink reservoir 22. When the push rod 32*g* is largely curved, the ball 26 urged by the push rod 32*g* is instantaneously released, and air compressed in the cap 29*g* is instantaneously pressed into the ink reservoir 22. Thus, the pressed-in air is prevented from forming air bubbles and diffusing in ink. When the push rod 31*g* is bent, the front end portion of the push rod 31*g* inserted in the ink reservoir 27 is moved back and forth. The front end portion of the push rod 32*g* spins or whirls in the ink passage 22 to remove correction liquid containing air and/or fine air bubbles.

Such a structure is beneficial to manufacture of writing instruments including markers. It is costly to form a coil portion on a push rod of the previous embodiments. On the contrary, since the push rod 32*g* is linear in the eighth embodiment and can be formed by cutting a piano wire or the like into a piece having a predetermined length, it can be manufactured at a low cost. Burrs are formed on the cut end of the push rod when it is cut. The end of the push rod formed with burrs is caught on the inner surface of the small-diameter ink passage and is prevented from moving smoothly. It is necessary and thus costly to remove the burrs by polishing or the like. It is low in efficiency to polish push rods formed from such thin wires at their burred ends one by one. Although it is efficient and low in cost to remove burrs from the cut end of a plurality of push rods by tumble-polishing together with abrasives in a tumbling barrel. When coil springs are formed on push rods, they tangle together and thus cannot be polished. On the other hand, linear push rods 32*g* of the eighth embodiment can be polished at a low cost.

Figure 20:
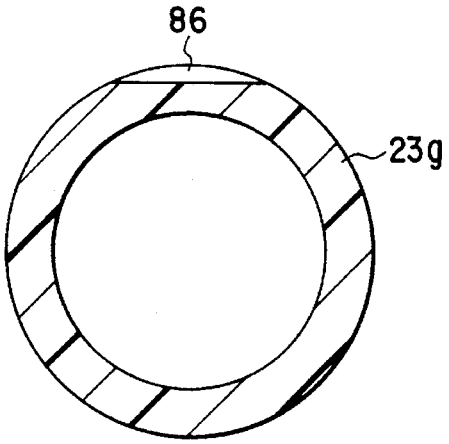
FIG. 20 is a longitudinal cross-sectional view along line 20—20 of FIG. 18.
Figure 21:
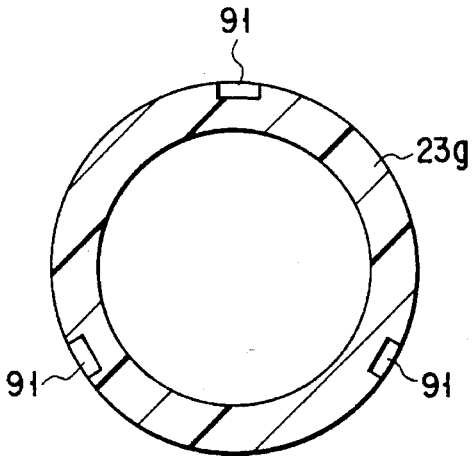
FIG. 21 is a cross-sectional view of another discharge portion.

The eighth embodiment uses a cap having generally the same structure as those of the fifth and sixth embodiments. The smooth compression sliding portion 85 is formed on the outer peripheral surface of the nib holder 23*g*. In the rear end portion of the compression sliding portion 85 is formed a discharge portion which comprises a discharge groove 86 formed by removing a part of the outer peripheral surface of a nib holder 23*g* as shown in FIG. 20. A seal fitting portion 87 having a smooth surface similar to the compression sliding portion is formed at the rear end side of the discharge groove 86.

Figure 19:
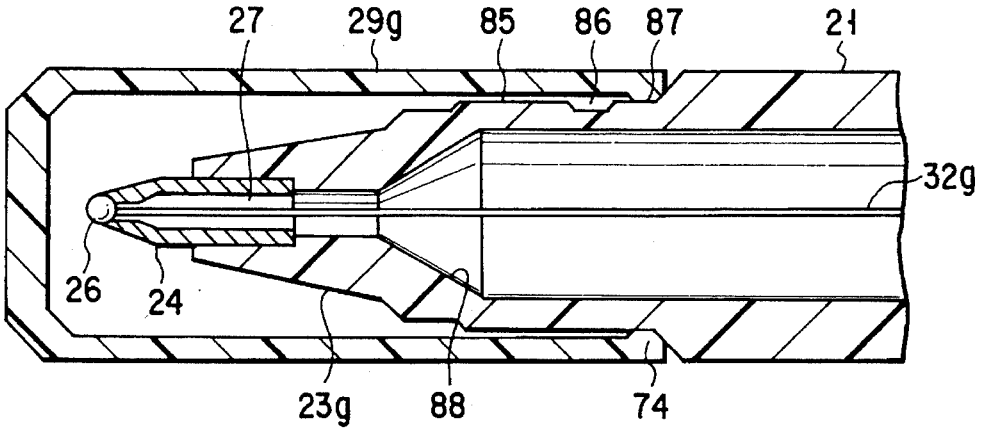
FIG. 19 is a longitudinal cross-sectional view of the nib and its vicinity of the writing instrument according to the eighth embodiment with the cap fitted on the instrument body.

When the sealing projection 74 slides on the compression sliding portion 85 to fit the cap 29*g*, air in the cap 29*g* is compressed. As the sealing projection 74 passes the discharge groove 86 of the cap 29*g*, the pressure in the cap is discharged to the outer atmosphere through the discharge groove 86, and the pressure in the gap is lowered to the atmospheric pressure. In a state in which the cap 29*g* is fitted fully, the sealing projection 74 is fitted on the fitting portion 87 as shown in FIG. 19, whereby the interior of the cap 29*g* is interrupted from its exterior in an air tight state.

Since pressing compressed air into the ink reservoir 22 upon fitting the cap of this type is interrupted for a short time, fine air bubbles are prevented from diffusing in ink similarly to the cases of the fifth and sixth embodiments. Upon fitting the cap fully, the interior of the cap is sealed hermetically. Thus, ink is prevented from being dried. When the writing instruments are transported by airplane, the pressure in he cap 29*a* is maintained at the atmospheric pressure even if the environmental pressure is lowered. Thus, the pressure difference between the interior of the ink reservoir 22 and the interior of the cap 29*g* does not become large, and ink is securely prevented from leaking from the nib.

Figure 22:
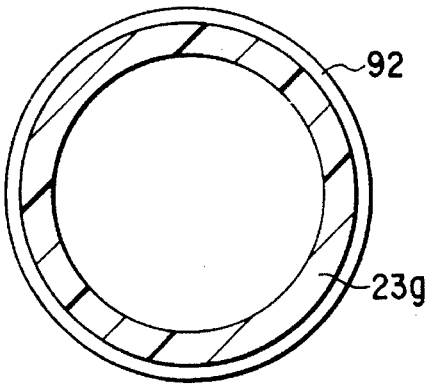
FIG. 22 is a cross-sectional view of a further discharge portion.

The discharge portion is not limited to the discharge groove 86 but may be a plurality of discharge grooves 91 formed in a plurality portions of the nib holder. As shown in FIG. 22, a small-diameter portion 92 having an outer diameter smaller than the inner diameter of the seal sealing projection 74 of the cap 29*g* may be formed at the discharge portions.

Figure 23:
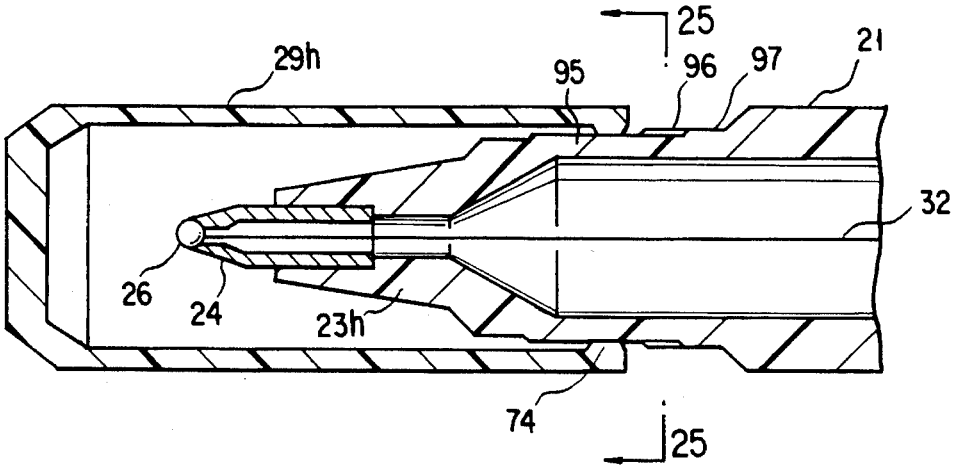
FIG. 23 is a cross-sectional view of a still further discharge portion is a longitudinal cross-sectional view of a further cap.
Figure 24:
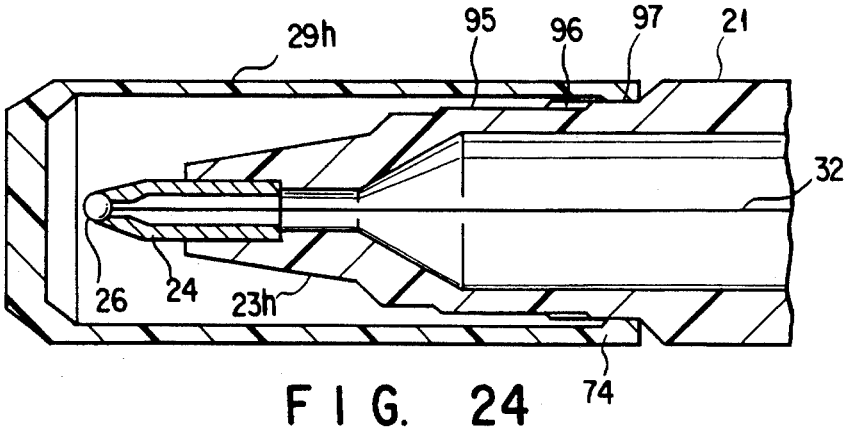
FIG. 24 is a longitudinal cross-sectional view of the cap in state in which the cap of FIG. 24 is fully fitted on the main body.
Figure 25:
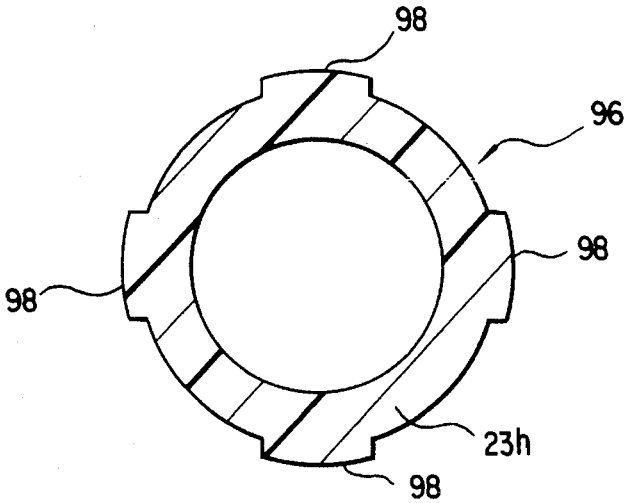
FIG. 25 is a cross-sectional view along 25—25 line of FIG. 23.

FIGS. 23 to 25 show a further embodiment of a cap. Similarly to the cap as shown in FIG. 19, a compressor sliding portion 95 having a smooth surface is formed on the outer peripheral surface of part of a nib holder 23*h*. A discharge portion 96 is formed on the rear end portion of the compression sliding portion 95. On the rear edge of the discharge portion 96 is formed a seal fitting portion 97 having a smooth surface similarly to the smooth surface of the compression sliding portion 95. As shown in FIG. 25, a plurality of projections 98 are formed on the outer peripheral surface of the discharge portion 95. As the cap 27*h* is fitted on nib holder 23*h*, the projection 74 rides on the projections 98 of the discharge portion 96. A space is formed between the projection 74 and the outer peripheral surface of the nib holder 23*h* so that air compressed in the cap 29*h* is discharged to the outer atmosphere through the space. The structure and the operation of the other portions of the nib portion of the embodiment of FIGS. 23 to 25 than the structure of the discharge portion 96 are the same as those of the nib portion of the embodiment of FIG. 19. The discharge portion provided with the projections 98 may be formed on such positions of the nib portion 23*e* that the interior of the cap 29*h* communicates with the exterior thereof when the cap 29*h* is fully fitted on the nib portion 23*e* like the embodiment as shown in FIG. 13.

The present invention is not limited to the abovementioned embodiments. For example, the present invention is not limited to a correction liquid marker but is applicable to a paint marker, a nail marker, a white board marker and any one of the writing instrument.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A writing instrument which is provided with: a main body; an ink reservoir defined inside the main body; nib provided at a front end portion of the main body; and an ink passage for allowing communication between the ink reservoir and the nib, and in which not only ink but also pressurized air is sealed in an interior of the ink reservoir, and the ink is supplied to the nib utilization of pressure produced by the pressurized air, said writing instrument comprising;

valve means provided in the nib and having a valve function, said valve means including a valve member, said valve member being moved to a distal end position and preventing the ink from flowing out by shutting off communication between the ink reservoir and an external region when the writing instrument is not in use, and said valve member being moved to a position opposing the distal end position by writing pressure and permitting the ink to flow out by allowing the communication between the ink reservoir and the external region when the writing instrument is in use;

urging means, made of a push member, for urging the valve member toward the distal end position, thereby maintaining the valve member in a closed state, said urging means being extended axially and received in the ink reservoir and having a distal end portion which is led to the distal end position by way of the ink passage, said distal end portion of the urging means having a distal end which is in contact with the valve member and which elastically urges the valve member toward the distal end position;

a cap slidably fitted on the front end portion of the main body and maintaining a hermetical state, air inside the cap being compressed when the cap is fitted around the distal front end portion of the main body, said compressed air moving the valve member in an opposite direction to that of the distal end position, thus setting the valve member in an open state, said compressed air flowing from said cap into the ink reservoir by way of both a pen body and the ink passage, thereby replenishing the pressurized air sealed in the ink reservoir;

a stirring weight received in said ink reservoir and being movable at least in an axial direction thereof, said stirring weight being moved inside the ink reservoir and stirring the ink contained in the ink reservoir when the writing instrument is shaken, said stirring weight interfering with the urging means when moved in said ink reservoir and displacing the urging means, thus permitting the urging means to stir the ink contained in the ink passage, said displaced urging means momentarily releasing the valve member from an urged state, thereby permitting the compressed air inside the cap in the fitted state to easily flow into the ink reservoir by way of the nib.

2. A writing instrument according to claim 1 further providing a cap on said front end portion of said main body, for compressing air in said cap and introducing said air into said ink reservoir through said nib to press said interior of said ink reservoir.

3. A writing instrument according to claim 2, wherein said nib comprises a ball tip provided with a rollable ball and also acts as said valve means, said ball closes said ball tip when said ball is moved forward and to open said ball tip when said writing instrument is used, said push member of said urging means comprises a push rod having a small diameter, said push rod has a front end portion inserted in said ink passage and abutting against said ball to urge said ball forward to close said ball tip, and said stirring weight interferes with said push rod according to movement of said stirring weight to displace said rod to release said ball from said ball tip so as to accelerate pressing said air under pressure in said cap into said ink passage and so as to stir said ink in said ink passage.

4. A writing instrument according to claim.1, wherein said urging means is provided with a push rod having a small diameter and extending into said ink reservoir, said push rod urges said valve means to be closed, and said stirring weight interferes with said push rod thus extended to displace said push rod.

5. A writing instrument according to claim 2, wherein said cap is slidably fitted on said front end portion of said main body in a hermetical state and comprises a compression sliding portion for compressing said air in said cap upon fitting said cap on said front end portion of said main body and a discharge portion provided in a rear portion of said compression sliding portion and causing an interior of said cap to communicate with an exterior of said cap in a state in which said cap is fully fitted on said front end portion of said main body to discharge said air compressed in said cap.

* * * * *